United States Patent [19]

Keith et al.

[11] Patent Number: 4,805,353

[45] Date of Patent: Feb. 21, 1989

[54] PEDESTAL VACUUM SYSTEM FOR GRINDER OR OTHER TOOL

[75] Inventors: Malcolm E. Keith, West Chicago; Michael P. Cayley, South Barrington, both of Ill.

[73] Assignee: Midaco Corporation, Elk Grove Village, Ill.

[21] Appl. No.: 158,723

[22] Filed: Feb. 22, 1988

[51] Int. Cl.[4] ..... B24B 55/06

[52] U.S. Cl. ..... 51/273; 51/166 FB

[58] Field of Search ..... 51/270, 273, 166 R, 51/166 FB

[56] References Cited

U.S. PATENT DOCUMENTS

| | | | |
|---|---|---|---|
| 1,177,342 | 3/1916 | Leiman | 51/273 |
| 1,528,439 | 3/1925 | Leiman | 51/273 |
| 2,236,232 | 3/1941 | Brescka et al. | 51/270 |
| 2,512,930 | 6/1950 | Gilmore | 51/273 |
| 4,578,907 | 4/1986 | Cayley et al. | 51/268 |

FOREIGN PATENT DOCUMENTS

| | | | |
|---|---|---|---|
| 592773 | 9/1947 | United Kingdom | 51/273 |

*Primary Examiner*—Roscoe V. Parker

[57] ABSTRACT

A stand or pedestal for grinders or other tools which includes a top upon which one or more grinders are mounted and includes an upper storage compartment and an inlet chamber connected to provide suction to the grinders and with a filter mounted in an opening formed in the inlet passage. A blower is mounted in a third compartment below the inlet compartment and has an exhaust opening. A motor is connected to the impeller or fan to drive it and the fan sucks air from the grinder into the inlet compartment through the filter and forces it out the exhaust opening. A sealed door is provided over the inlet compartment and the fan compartment to allow the filter to be changed.

4 Claims, 1 Drawing Sheet

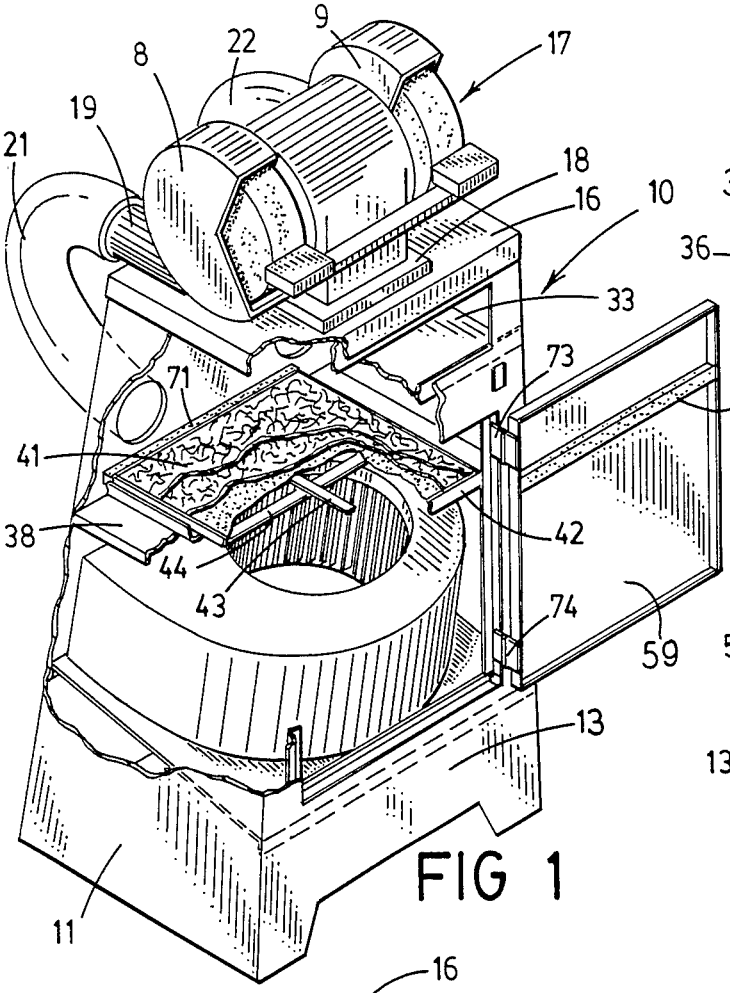
FIG 1
FIG 2
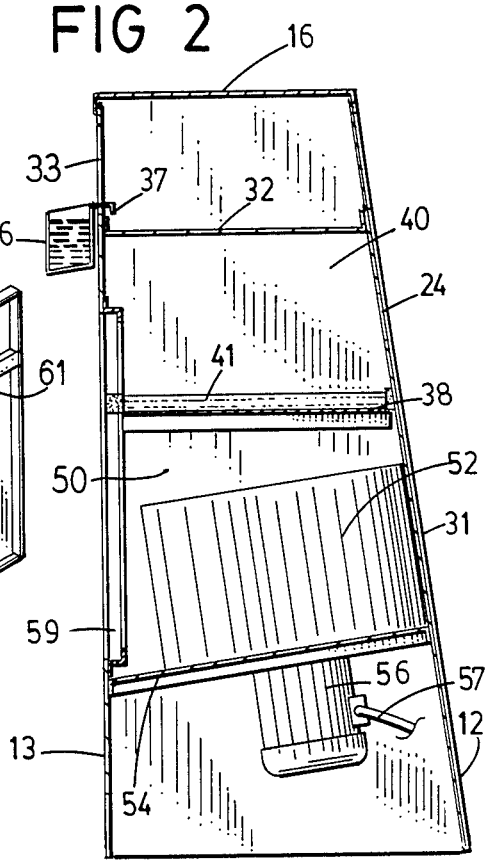
FIG 3
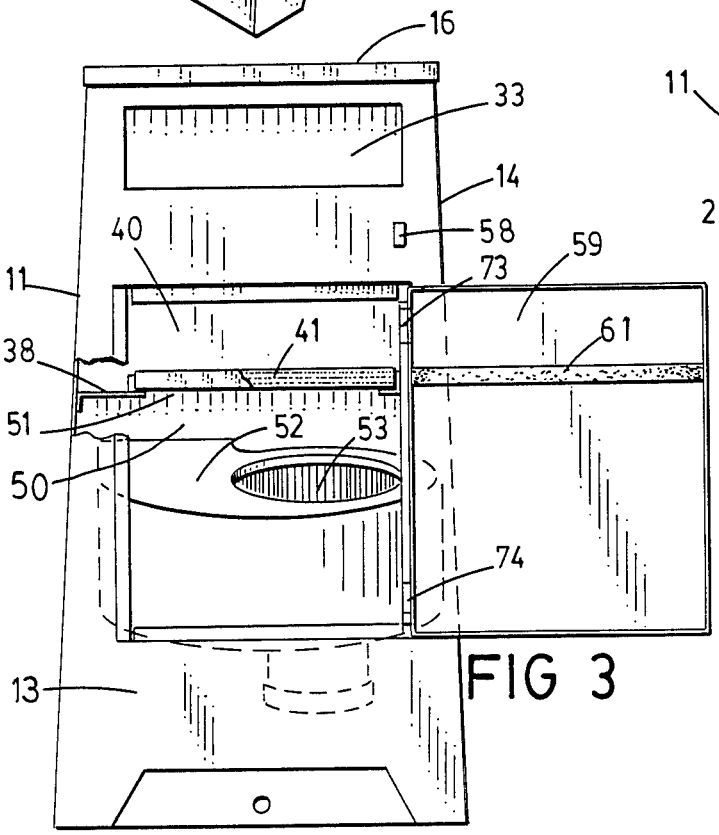
FIG 4
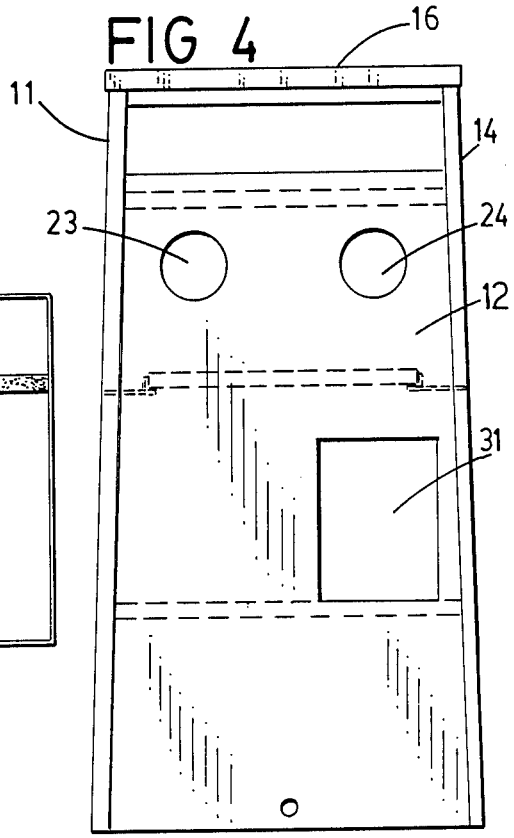

PEDESTAL VACUUM SYSTEM FOR GRINDER OR OTHER TOOL

CROSS-REFERENCE TO RELATED APPLICATIONS

This application is an improvement on application Ser. No. 088,700 filed Aug. 24, 198 entitled "Combination Pedestal And Vacuum System" which is assigned to the assignee of the present application.

BACKGROUND OF THE INVENTION

1. Field of the Invention

This invention relates in general to grinding machines and particular to a novel combination pedestal and vacuum system.

2. Description of the Related Art

Grinder wheels having guards are disclosed in U.S. Pat. No. 4,578,907 which is assigned to the assignee of the present invention. Such grinder wheels produce substantial amounts of dust and particulate matter as grinding occurs and it is desirable to remove the dust and particulate from the vicinity of the grinders so that the operator can clearly see the results of the grinding and also for health reasons so as to remove such material so that it will not be inhaled by the operator.

SUMMARY OF THE INVENTION

It is an object of the present invention to provide an improved combination pedestal and vacuum system for a grinder or other tool wherein the pedestal is formed with a number of compartments located over each other with the first compartment being a storage compartment andthe second compartment being an inlet air compartment which is connected bytubes to the grinders so as to withdraw dust and particulate from the grinder. An opening is formed between the second compartment and a third compartment in which a fan or blower is mounted and a filter is detachable mounted over said opening. The filter may have three layers such as coarse, medium and fine impregnated with wax and is wire reinforced around the edges and through the center. A motor for the fan may be mounted ina compartment underneath the fan compartment and the fan and motor are tilted at an angle so that the exhaust is flush with a tilted back of the pedestal. A sealed door is provided in the wall of the pedestal so that the filter can be periodically cleaned or replaced.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 1 is a partially cut-away perspective view of the invention;

FIG. 2 is a side sectional view of the machine of FIG. 1;

FIG. 3 is a front plant view of the invention; and

FIG. 4 is a rear plan view of the invention.

DESCRIPTION OF THE PREFERRED EMBODIMENTS

FIGS. 1–4 illustrate the pedestal 10 of the invention which comprises the side walls 11 and 14 and a rear tapered wall 12 and a front wall 13. The top 16 serves as a pedestal for mounting a pair of grinders 17 which have a base 18 which is connected to the top 16 by bolts or other suitable holding means. The grinders 17 are each provided with housings 8 and 9 which extend a substantial distance around the grinders so as to collect dust and particulate matter. The housing 8 connects to a conduit 19 which is connected by a flexible conduit 21 to an opening 24 in the backwall 12 of the pedestal. A flexible conduit 22 is connected to the housing 9 and has its other end connected to an opening 23 in the backwall 12.

A first storage compartment is formed in the upper portion of the pedestal 10 and the bottom of the storage compartment comprises a floor 32 which extends between the walls 11, 12, 13 and 14. An openings 33 extends into the storage compartment thus formed and a water container 36 may be connected by a holding hook 37 to the pedestal by extending it into the opening 33 as shown in FIG. 2, for example.

A filter 41 is mounted below the partition 32 to form an intake chamber 40. The lower portion of the intake compartment 40 is formed with an opening 51 about which a ledge 38 extends which receives filter 41. The filter 41 is formed with an outer frame member 42 and cross brace members 43 and 44. The filter 41 is formed of fiber material and may have coarse, medium and fine layers impregnated with wax.

A fan 52 is mounted in a lower compartment 50 beneath the filter 41 and has a blower or impeller 53. The fan 52 is mounted on a slanting partition 54 as illustrated in FIG. 2 such that the outlet opening of the fan 52 mates with an opening 31 formed in the backwall 12 as shown in FIG. 4. A motor 56 is mounted below the partition 54 and is connected to the blower 53 of the fan 52. A door 59 is mounted on hinges 73 and 74 and is received in an opening formed in the wall 13. A seal 61 mates with the filter 41 to provide an air seal between the inlet chamber 40 and the blower chamber 50. A suitable latch is provided for the door 49 so it can be locked in the closed position.

In operation, the grinders 17 are energized and the fan motor 56 is turned on by closing a switch 58 mounted in the front wall 13. The door 59 is closed during operation. The fan 52 sucks air through the filter 41 and creates a low pressure in the chamber 40 which draws air from the housings 8 and 9 of the grinders through the conduits 21 and 22 through openings 23 and 24 into the inlet chamber 40, then through filter 41 and into the fan 52 and out the exhaust opening 31.

The filter 41 can be cleaned or changed when the grinders are not in use by opening the door 59 and removing the filter 41 to clean or replace it.

It is seen that the invention provides a new and novel pedestal and although it has been described with respect to preferred embodiments, it is not to be so limited as changes and modifications may be made therein which are within the full intended scope as defined by the appended claims.

We claim as our invention:

1. A combination stand and vacuum cleaning system for a power tool comprising, a rectangularly shaped pedestal formed with a top surface, a top inlet compartment formed in said pedestal, a power tool mounted on said top surface of said pedestal, a conduit extending from said power tool and having a second end in communication with said top inlet compartment, said top inlet compartment formed with a floor in which an opening is formed, a planar filter mounted over said opening in said floor, a second compartment in said pedestal formed with a floor and an exhaust outlet in a backwall below said top inlet compartment, a blower mounted on the floor of said second compartment and said blower having an exhaust which is connected to said exhaust oulet in the backwall of said second compartment, a motor connected to said blower and mounted below the floor of said second compartment, and said floor of said second compartment and said backwall of said pedestal are tilted.

2. A combination stand and vacuum cleaning system according to claim 1 comprising, a storage compartment formed above said inlet compartment in said pedestal.

3. A combination stand and vacuum cleaning system according to claim 1 including an air tight door formed in a wall of said pedestal which when opened allows access to said planar filter and blower.

4. A combination stand and vacuum system according to claim 3 including a seal attached to said door which mates with said filter when said door is closed.

* * * * *